US008210236B2

(12) United States Patent
Godin

(10) Patent No.: US 8,210,236 B2
(45) Date of Patent: Jul. 3, 2012

(54) METHOD OF AND APPARATUS FOR MEASURING SEPARATION OF CASTING SURFACES

(75) Inventor: Daniel Godin, Trois Rivieres (CA)

(73) Assignee: Novelis Inc., Toronto (CA)

( * ) Notice: Subject to any disclaimer, the term of this patent is extended or adjusted under 35 U.S.C. 154(b) by 27 days.

(21) Appl. No.: 12/802,517

(22) Filed: Jun. 7, 2010

(65) Prior Publication Data

US 2010/0326618 A1 Dec. 30, 2010

Related U.S. Application Data

(60) Provisional application No. 61/269,904, filed on Jun. 29, 2009.

(51) Int. Cl.
*B22D 11/00* (2006.01)

(52) U.S. Cl. ..... 164/451; 164/4.1; 164/151.2

(58) Field of Classification Search ..... 164/451, 164/4.1, 151.2
See application file for complete search history.

(56) References Cited

U.S. PATENT DOCUMENTS

| | | | | |
|---|---|---|---|---|
| 3,855,523 | A * | 12/1974 | Pirlet | 324/207.25 |
| 3,937,270 | A | 2/1976 | Hazelett et al. | |
| 4,294,305 | A | 10/1981 | Oda | |
| 5,069,234 | A | 12/1991 | Nielsen | |
| 5,086,827 | A | 2/1992 | Graham et al. | |

FOREIGN PATENT DOCUMENTS

JP 2002296001 A * 10/2002

* cited by examiner

*Primary Examiner* — Nicholas D'Aniello
(74) *Attorney, Agent, or Firm* — Cooper & Dunham LLP

(57) ABSTRACT

Exemplary embodiments of the invention provide a method of measuring the separation of moving confronting casting surfaces within a casting cavity of a casting apparatus. The method involves attaching at least one separation sensing device to a first one of a pair of confronting casting surfaces outside the casting cavity and then moving the casting surfaces to advance the sensing device(s) through the casting cavity while operating the device(s) to generate signals. The signals are monitored continuously or at regular intervals and converted to distance measurements representing separation of the surfaces at a plurality of positions through the casting cavity. Other exemplary embodiments provide apparatus for carrying out the method, and methods of measuring irregularities of casting belts or the like.

11 Claims, 6 Drawing Sheets

METHOD OF AND APPARATUS FOR MEASURING SEPARATION OF CASTING SURFACES

CROSS-REFERENCE TO RELATED APPLICATION

This application claims the priority right of currently co-pending provisional patent application Ser. No. 61/269,904 filed Jun. 29, 2009 by applicants herein. The entire contents of application Ser. No. 61/269,904 are specifically incorporated herein by this reference.

BACKGROUND OF THE INVENTION (1) Field of the Invention

This invention relates to the casting of metal strip articles by means of continuous strip casting apparatus of the kind that employs continuously moving elongated casting surfaces. More particularly, the invention relates to a method of and apparatus for measuring variations of the separation of such surfaces within the casting region of the apparatus.

(2) Description of the Related Art

Metal strip articles (such as metal strip, slab and plate), particularly those made of aluminum and aluminum alloys, are commonly produced in continuous strip casting apparatus. In such apparatus, molten metal is introduced between two closely spaced (usually actively cooled) elongated moving casting surfaces forming a narrow casting cavity. The metal is confined within the casting cavity until the metal solidifies (at least sufficiently to form an outer solid shell), and the solidified strip article is continuously ejected from the casting cavity at an exit by the moving casting surfaces and may be produced in indefinite length. One form of such apparatus is a twin-belt caster in which two confronting belts are circulated continuously and molten metal is introduced between the belts by means of a launder or injector into a thin casting cavity formed between the confronting regions of the belts. An alternative is a rotating block caster in which the casting surfaces are formed by blocks that rotate around a fixed path and join together adjacent the casting cavity to form a continuous surface. The metal is conveyed by the moving belts or blocks for a distance effective to solidify the metal, and then the solidified strip emerges from between the blocks at the opposite end of the apparatus.

It is desirable to make the casting surfaces as flat as possible, even though these surfaces may be made to converge, diverge or run parallel to each other, according to the dictates of particular casting procedures and conditions. When the surfaces are not flat, heat extraction from the metal being cast and application of force vary unpredictably and the resulting cast slab may show surface and/or internal defects. Variations of the casting surface from planar may result from distortions or displacements of the elements that form the casting surfaces caused by such things as welds used to construct the elements, exposure to heat and flexing and/or from distortions of underlying supports used to guide the moving elements. For example, in the case of belt casting apparatus, the reverse surfaces of the belts are generally supported on and slide over surfaces made up of numerous flat closely packed stationary nozzles that may diverge from a planar orientation with each other and may also individually twist out of the intended orientation, especially as they are used to deliver a stream of cooling water to the reverse surfaces of the belts.

While it is possible to remove the casting belts from the casting apparatus to subject them and their supports to checks for flatness, this is labor-intensive and requires the apparatus to be cooled and the supply of cooling water to be terminated. It would be advantageous to be able to check for deviations from flatness with the casting elements in place and the water supply in operation, as this would give results more in keeping with actual casting conditions. However, the nature of the casting cavity (being relatively thin but of considerable length and breadth) makes this difficult, as does the fact that the apparatus may be quite hot if it has already been used for previous casting operations.

U.S. Pat. No. 4,294,305 issued to Oda on Oct. 13, 1981 discloses a device for measuring a gap between a plurality of roll pairs designed to guide and bend a steel ingot around a radius after it exits a vertically-positioned mold. However, the patent is not concerned with measuring a casting cavity.

U.S. Pat. No. 3,937,270 to Hazelett et al. issued on Feb. 10, 1976 uses an array of fixed mechanical and thermal probes arranged on the reverse side of belts used to form a casting cavity. The mechanical probes contact the belts directly and measure transverse buckling. However, the casting cavity is not measured directly.

U.S. Pat. No. 5,086,827 to Graham et al. issued on Feb. 11, 1992 discloses the use of one or more fixed non-contact sensors for measuring belt flatness in a twin belt casting apparatus. As in the Hazelett et al. reference mentioned above, the sensors are positioned at the reverse surfaces of the belts and do not measure the separation and flatness of the surfaces forming the casting cavity itself.

There is therefore a need for a method and apparatus for directly measuring the spacing and flatness of surfaces forming a casting cavity for strip article casting.

BRIEF SUMMARY OF THE INVENTION

Exemplary embodiments of the invention provide a method of measuring the separation of moving confronting casting surfaces within a casting cavity of a casting apparatus. The method involves attaching at least one separation sensing device (preferably operating by sensing of electromagnetic inductance) to a first one of a pair of confronting casting surfaces outside a casting cavity, moving the casting surfaces to advance the at least one sensing device through the casting cavity while operating the devices to generate signals, monitoring the signals continuously or at regular intervals, and converting the monitored signals to distance measurements representing separation of the surfaces at a plurality of positions through the casting cavity. The sensor devices are preferably removably attached to the first casting surface by releasable means, e.g. magnetism, vacuum, releasable (weak) adhesion, etc., and may be adjusted in height before the moving of the casting surfaces advances the at least one device into the casting cavity (thereby placing the devices within better sensing range of the second casting surface).

It is to be noted that, while it is preferred to provide a plurality of sensor devices for each measurement run, it would alternatively be possible to use just a single sensor device to measure the entire casting cavity, e.g. by advancing the single sensor device through the casting cavity numerous times for numerous measurement passes while moving the sensor laterally to a new position for each pass. When more than one sensing device is used, they are each attached to the one casting surface of the pair with the sensors separated laterally from each other. An alignment unit may be used to position the sensor devices precisely on the one casting surface. The alignment unit may be positioned on the surface before the attaching of the sensor devices.

The exemplary embodiments may be employed to carry out a single measuring pass or, alternatively, two or more measuring passes so the resulting separation measurements can be compared to check for consistency of the results and combined to provide an average. It is possible to carry out more than one measuring pass by removing the sensor devices at the end of one pass, re-positioning them in advance of the casting cavity, and then carrying out a second measuring pass. Alternatively, the sensor devices may simply be drawn back through the casting cavity after one measuring pass, relocated to a position in advance of the casting cavity, and then used for a second measuring pass. Preferably, between each measuring pass, the sensor device(s) is (are) moved laterally across the casting surface to measure separation at different lateral positions through the casting cavity on each measuring pass. The results may be combined to provide a representation of the separation of the casting surfaces over the entire area of the casting cavity.

Another exemplary embodiment provides a method of measuring the separation of moving confronting casting surfaces within a casting cavity of a casting apparatus, which involves positioning at least one separation sensing device on a first one of a pair of confronting casting surfaces outside a casting cavity, maintaining the casting surfaces stationary and advancing the at least one sensing device through the casting cavity while operating the devices to generate signals, monitoring the signals continuously or at regular intervals, and converting the monitored signals to distance measurements representing separation of the surfaces at a plurality of positions through the casting cavity.

Yet another exemplary embodiment provides a method of measuring the separation of moving confronting casting surfaces within a casting cavity of a casting apparatus, which involves positioning at least one separation sensing devices on a first one of a pair of confronting casting surfaces outside a casting cavity, moving the first one of the pair of casting surfaces to advance the at least one sensing device into the casting cavity and then stopping further movement of the first surface, moving a second one of the pair of casting surfaces through the casting cavity, operating the at least one sensing device to generate signals, monitoring the signals continuously or at regular intervals, and converting the monitored signals to distance measurements representing separation of the surfaces at a plurality of positions through the casting cavity.

Yet another exemplary embodiment of the invention provides apparatus for measuring spacing between casting surfaces within a casting cavity of strip metal casting equipment, which apparatus comprises at least one sensing device removably attached to one of a pair of moving casting surfaces forming a casting cavity, the at least one sensing device having a height that allows the device to enter and pass through the casting cavity with clearance and comprising a sensing unit for detecting separation of the unit from a second one of the pair of casting surfaces, the sensor generating signals corresponding to the detected separation. The apparatus further includes a receiver for receiving the signals from the at least one sensor device, and a converter for converting the signals to numerical values corresponding to the detected separation.

A further exemplary embodiment provides apparatus for measuring spacing between casting surfaces within a casting cavity of strip metal casting equipment. The apparatus includes at least one sensing device having a height that allows the device to enter and pass through with clearance a casting cavity formed between a spaced confronting pair of casting surfaces. The sensing device is positionable on a first one of the casting surfaces and has a sensing unit for detecting separation of the unit from a second one of the casting surfaces. The sensing device also has temporary attachment element (e.g. a magnetic element, a suction cup, a vacuum generator, a layer of releasable adhesive, etc.) by means of which the sensing unit may be temporarily attached to the first of the casting surfaces. The apparatus includes an alignment unit having one or more recesses for positioning the or each of the sensor devices precisely at a predetermined position on the first casting surface, the alignment unit being adapted for removable attachment to said first one of the casting surfaces. The sensing unit generates signals corresponding to the detected separation and the apparatus includes a receiver for receiving the signals from the sensor device, and a converter for converting the signals to numerical values corresponding to the detected separation.

While the apparatus may have just one sensing device, there are preferably two or more such devices operated at the same time. The devices preferably work by electromagnetic inductance when brought into close proximity to metal casting surfaces.

The sensing device preferably includes a spacing element positioned between the sensor unit and the temporary attachment element, the spacing element being dimensioned to position the sensor unit within detection range of the second casting surface. The spacing element is preferably detachable from the sensor unit.

Generally, the or each of the sensor devices is connected to the receiver by an elongated flexible communication cable, the cable having a length greater than a length of the casting cavity to allow the sensor devices to pass completely through the casting cavity without restraint from the cables. The apparatus preferably also includes a clamp for clamping the elongated flexible communication cable(s), the clamp being releasably attachable to the second casting surface so that it absorbs the force of any tension on or within the cables.

The apparatus preferably also includes an alignment unit having one or more recesses for positioning the or each of the sensor devices precisely at a predetermined position on the first casting surface, the alignment unit preferably being made of a magnetic material or having a temporary attachment element on one side thereof adapted for removable attachment to the first casting surface.

The exemplary embodiments may also comprise a kit of parts containing one or other combination of the above elements in unconnected association. Such a kit preferably contains written instructions explaining the assembly and use of the kit for the methods of measuring set out above.

Preferred ones of the exemplary embodiments have the advantage of using the motion of the belts themselves to smoothly advance a row of sensors through the casting cavity without having to resort to separate locomotion means or to the provision of stationary sensors.

BRIEF DESCRIPTION OF THE SEVERAL VIEWS OF THE DRAWINGS

Exemplary embodiments of the invention are described in more detail in the following with reference to the accompanying drawings, in which.

DETAILED DESCRIPTION OF THE EXEMPLARY EMBODIMENTS

Figure 1:
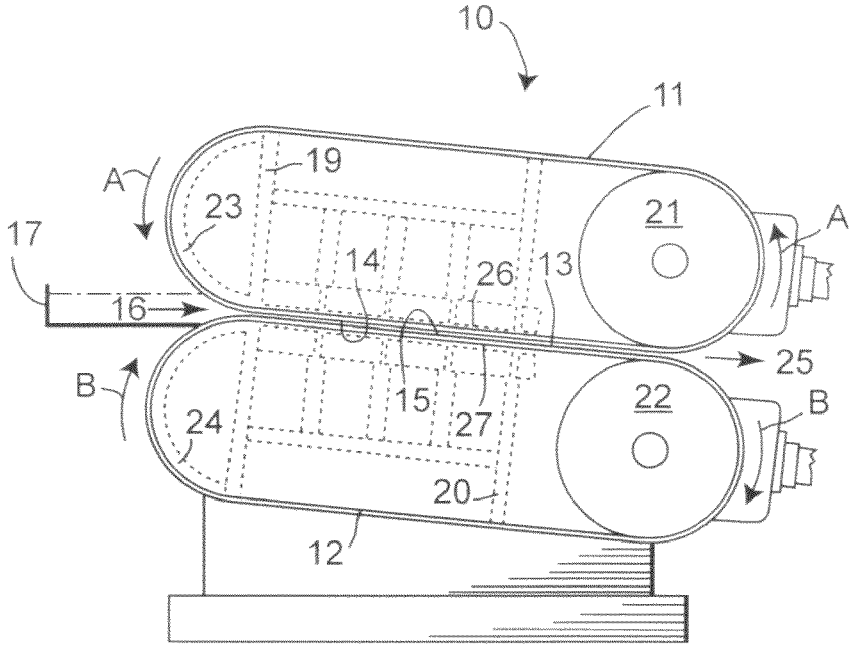
Fig. 1 (Prior Art)
FIG. 1 a schematic side view of a prior art twin belt casting apparatus as an example of the kind of casting apparatus with which the exemplary embodiments may be employed.
Figure 2:
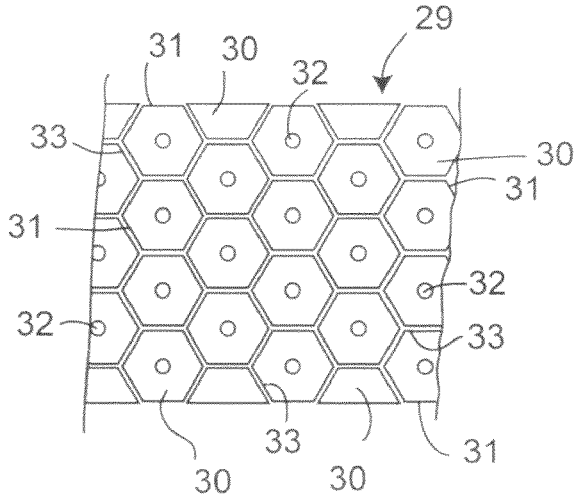
Fig. 2 (Prior Art)
FIG. 2 is a partial plan view of a support surface for casting belts as employed in the apparatus of FIG. 1, the surface being made up of hexagonal nozzles for directing cooling water to a reverse surface of the supported casting belt.

FIGS. 1 and 2 show an example of the kind of metal caster 10 with which the exemplary embodiments of the invention may be used. However, it should be kept in mind that the exemplary embodiments may be used with casting equipment of other kinds.

The caster 10 of FIG. 1 has two metal casting belts 11 and 12 that rotate in the directions shown by arrows A and B. Parts of the belts confront each other with a small separation to form a casting cavity 13 defined between the confronting surfaces 14, 15 of the belts. Molten metal is introduced between the belts and into the casting cavity as indicated by arrow 16 from a launder 17 or alternatively from a metal injector nozzle (not shown). The belts are supported by stationary structures 19 and 20 and they rotate about driven rollers 21 and 22 at one end and about stationary curved surfaces 23 and 24 at the other end. As the molten metal is advanced through the casting cavity by the moving casting surfaces, the metal cools and eventually solidifies and emerges as a cast slab or strip (not shown) through exit 25 of the casting cavity. Cooling water is applied to the reverse surfaces 26, 27 of the belts where they pass through and define the casting cavity 13 to promote the cooling and solidification of the metal. The casting belts themselves are made of steel, or other ferrous metal, or other heat-conducting material, in the preferred embodiments.

As shown in FIG. 2, the casting belts, in the region of the casting cavity 13, are supported on stationary surfaces 29 made up of closely packed hexagonal flat surfaces 30 of individual adjustable cooling nozzles 31. Water is forced through central orifices 32 in the nozzles, thus producing a thin film of cooling water between the surfaces of the nozzles and the reverse surfaces of the casting belts. The water eventually drains away through the narrow spaces 33 provided between the nozzles. Essentially, therefore, the cooling belts ride on a thin film of cooling water supported by the surfaces 30. The nozzles 31, while being fixed in position during casting, may be individually adjusted (towards or away from the reverse surface of the casting belt they support) when the apparatus is being prepared for use. Thus, the stationary surface 29 can be made substantially planar so the casting surfaces of the casting belts are held planar within the casting cavity. However, irregularities may occur during casting operations, either to the positions of the nozzles 31 or to the shape of the belt, and such irregularities may cause deviations of the casting surfaces from the desired planar shape and relative orientation. Alternatively, the casting surfaces as a whole may tilt relative to each other, for example undesirably making the casting cavity wedge-shaped in transverse cross-section (although it is to be noted that the casting cavity is often deliberately made convergent or divergent in longitudinal cross-section, e.g. to allow for shrinkage of the metal as it cools and solidifies). As noted above, such deviations may result in surface or internal defects in the resulting cast slab because of irregular heat extraction through the belts or because of forces exerted on the solidifying metal as it cools and solidifies.

A preferred caster of the kind shown in FIG. 1 (which represents the so-called Novelis FlexCaster®) has a casting cavity with maximum dimensions of 250 cm (wide) by 100 cm (long), and minimum dimensions of 25 cm (wide) by 100 cm (long). The height of the casting cavity typically varies from 1 cm (or even as low as 0.5 cm) to 10 cm. A typical cast slab has a thickness (height) of about 1.6 cm.

Figure 3:
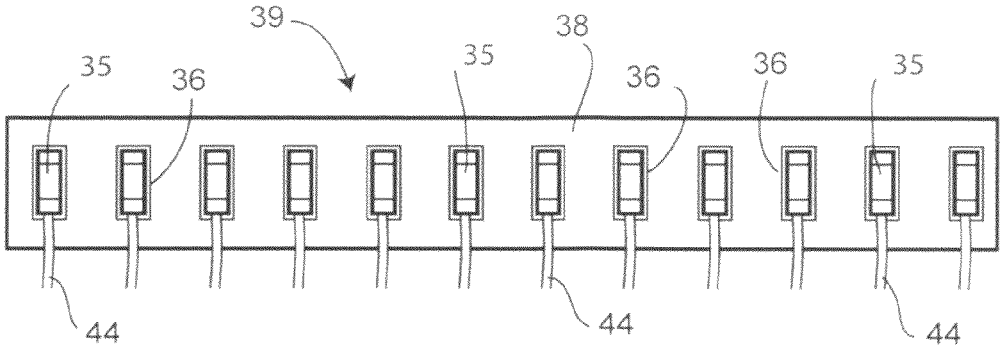
FIG. 3 is a plan view of an apparatus according to an exemplary embodiment for measuring separation between casting surfaces in the casting apparatus of the kind shown in FIGS. 1 and 2.
Figure 4:
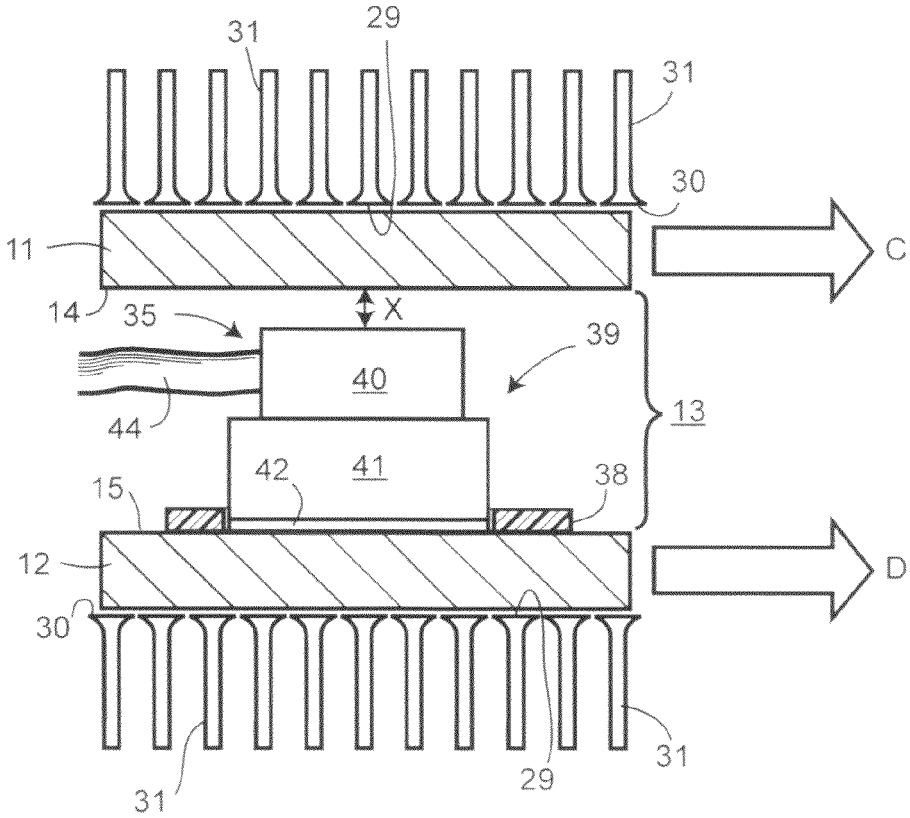
FIG. 4 is a cross-section of the apparatus of FIG. 3 shown in position within a casting cavity of a casting apparatus of the kind shown in FIGS. 1 and 2.

One exemplary embodiment of the apparatus of the invention is shown in isolation in the plan view in FIG. 3. The apparatus includes a number of sensor devices 35 (in this case twelve), positioned within recesses 36 of an elongated alignment unit 38. This assembly (sensor devices and alignment unit) may be referred to as a probe 39. FIG. 4 shows the probe in cross-section between two casting belts 11, 12 within a casting cavity 13 of the apparatus of FIGS. 1 and 2. The belts, when in operation, move in the direction of arrows C and D. Each of the sensor devices 35 is made up of an electromagnetic sensor unit 40, a spacing element 41 and a temporary attachment element 42. The sensor unit may be, for example, an inductive displacement sensor (e.g. Keyence® model EX-614V available from Keyence Corporation of America, 50 Tice Boulevard, Woodcliff Lake, N.J. 07677, U.S.A.). Inductive displacement sensor units of this kind utilize a high-frequency magnetic field which is generated by passing a high frequency current through a sensor head coil. When a metal target is present in the magnetic field, electromagnetic induction causes an eddy current perpendicular to the magnetic flux passage to flow on the surface of the target. This changes the impedance of the sensor head coil and the change in impedance may be detected. Such inductive displacement sensor units measure the distance between the sensor head and target casting belt based on this change in oscillation status. The sensor unit 40 is provided with a cable 44 used to deliver a signal to and/or from to a measuring device (as will be explained later) and to provide the high frequency current. The spacing element 41 may simply be a block of heat-resistant material (e.g. ceramic or metal, with aluminum being preferred because of its easy machinability) used to elevate the sensor unit 40 to a position close to the casting surface 14 of the upper casting belt 11, i.e. separated by a small distance X. This distance is determined by the sensing range of the sensor unit, which may only be a few mm (e.g. about 4 mm). The sensor unit 40 may be permanently attached to the spacing element 41, or it may be removably attached to the spacing element (e.g. by means of screws, an attachment bracket, releasable adhesive, and the like).

Temporary attachment element 42 is, in this embodiment, a thin magnet attached to the spacing element 41. The element 42 temporarily anchors the device to the casting surface 15 of the lower casting belt 12 by magnetic attraction (as the belt is made of steel or other ferromagnetic material). For a casting cavity having a height of about 1.6 cm, the sensor device 35 may (for example) have external dimensions of 1 cm (wide) by 3 cm (long) by 1 cm (high). For measurement of a casting cavity with a greater height, the height of the sensor device 35 would be increased in view of the limited sensing range of the sensor unit 40. Since the height of the sensor device 35 is known, and the distance X between the sensor unit 40 and the upper belt 11 is measured by the sensor device, the overall height of the casting cavity 13 (distance between the belts) can be determined.

The elongated alignment unit 38 is preferably made of an elongated thin strip of heat resistant material. The purpose of this unit is to facilitate the positioning of the sensor devices 35 with known spacing across the casting surface, e.g. in a direction at right angles to the casting direction. If the operator is prepared to position the sensor devices 35 without such facilitation, the alignment unit 38 may be omitted. In the illustrated embodiment, the alignment unit is provided with the same number of recesses 36 as the number of sensor devices 35 so that a single sensor device may be positioned in each recess. Two or more different alignment units (having recesses in different positions) may be used with a fixed number of sensor devices so that the positions of the devices can be changed between different measuring passes (sensing operations), if desired. The recesses pass completely through the alignment unit 38 so that the temporary attachment elements 42 may contact the casting surface 15 of the lower casting belt 12 directly. However, the recesses 36 have the same general shape as the outline of the bottom of the sensor device and are made only slightly larger so that the sensor devices are snugly held and precisely positioned by the sides of the recesses. The alignment unit 38 is preferably thin (e.g. one or two mm, or even less, e.g. if the unit is made from a removable adhesive tape provided with recesses), so that the cables 44 at the rear of the sensor devices may extend backwards without hindrance from the rear part of unit 38. The lower surface of the alignment unit may be provided with a temporary attachment element (not shown) similar to element 42 so that it may be attached magnetically to the casting surface, but alternatively the alignment unit 38 may itself be made of a magnetic material (e.g. flexible magnet sheet available from Rochester Magnet, of 119 Despatch Drive, East Rochester, N.Y., 14445, U.S.A.), or it may have a layer or releasable adhesive.

The apparatus is preferably operated in the following manner to measure the separation between the casting surfaces of the casting belts as they advance through the casting cavity of the apparatus.

Figure 5:
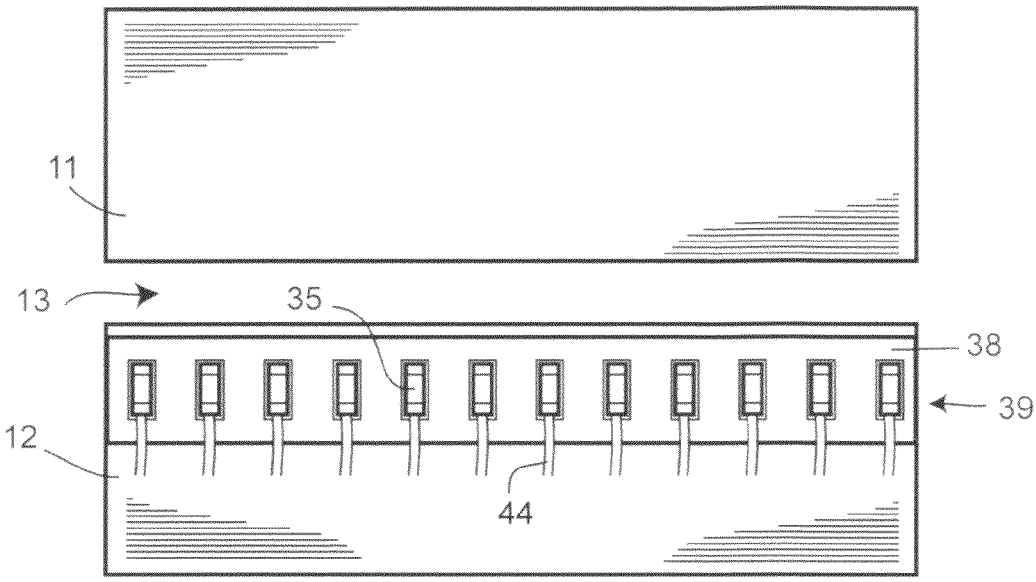
FIG. 5 is an entrance-side view of a casting apparatus according to FIG. 1 showing the casting belts (other casting equipment omitted for simplicity) and the attachment of the apparatus of FIG. 3 to a lower belt of a twin belt casting apparatus of the kind shown in FIGS. 1 and 2, the apparatus being outside the casting cavity.
Figure 6:
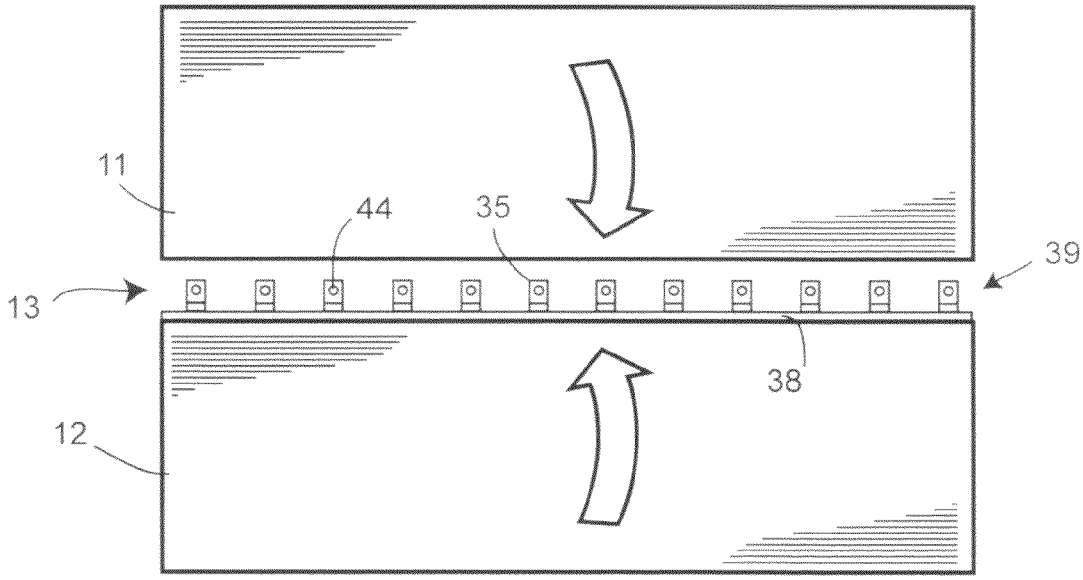
FIG. 6 is a view similar to FIG. 5 showing operation of the casting belts to move the apparatus of the exemplary embodiment into the casting cavity of the caster of FIGS. 1 and 2.
Figure 7:
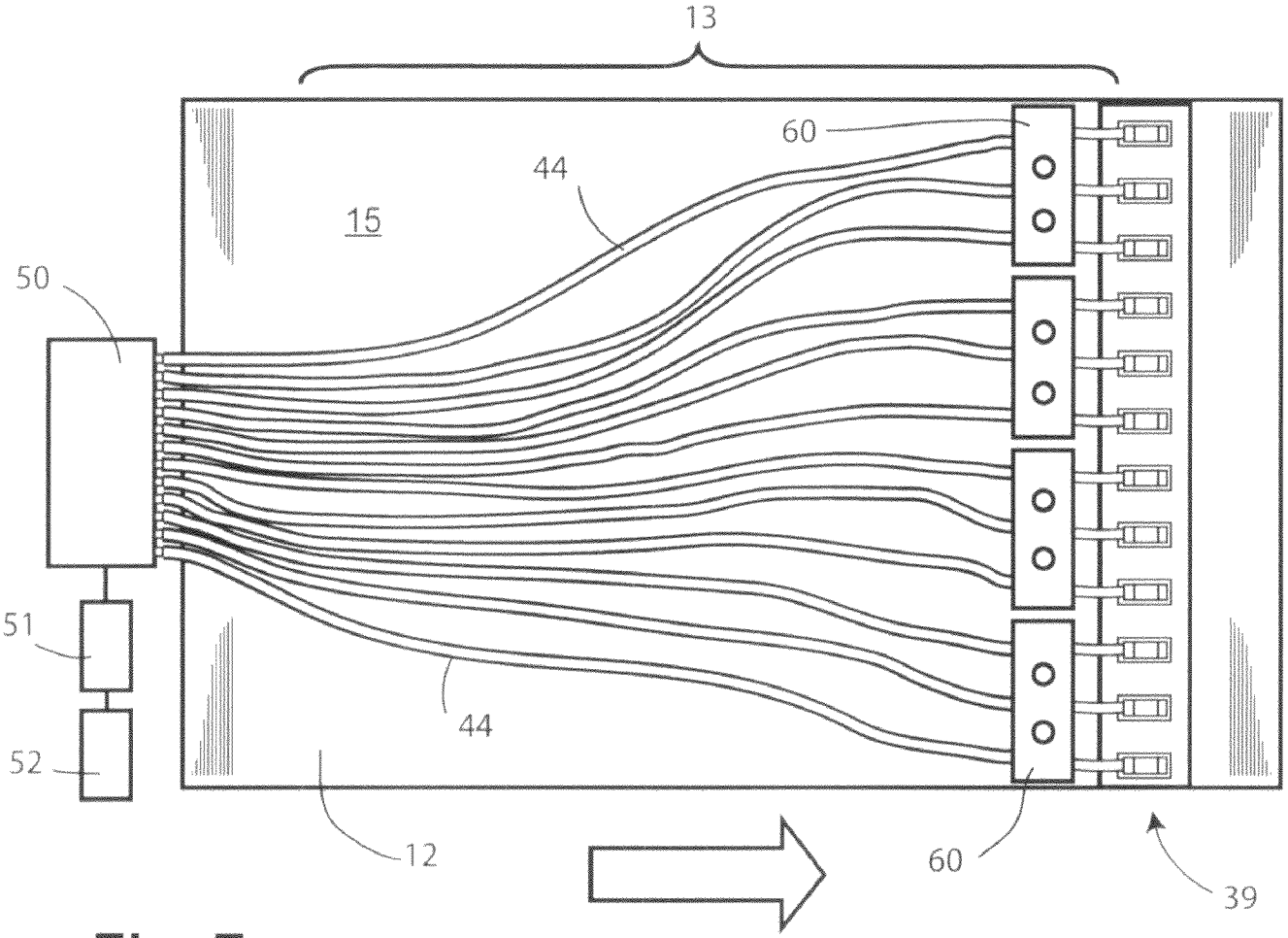
FIG. 7 is a top plan view of the apparatus of FIG. 6 with the top casting belt removed to reveal the apparatus of an exemplary embodiment and additional equipment.

Ideally, the apparatus is used soon after the termination of a casting operation while the caster is still hot or warm so that any heat-related distortions are still present. In view of this, a heat shield (not shown) may be used to protect the user of the apparatus and the measurement apparatus itself from radiated or conducted heat from the caster. This may take the form of a simple board of heat resistant material temporarily positioned between the entrance side of the lower casting belt and the operator. The belts are first cleaned of any casting debris, e.g. by spraying them with a pressurized cleaning fluid and brushing them with a rotating brush as the belts are rotated on the casting apparatus. The launder 17 or metal injector is removed from the caster to allow access to the front of the casting cavity. The side dams (not shown) conventionally used with a twin belt caster of the illustrated kind may be swung away, if desired. The probe 39 is attached to the lower casting belt just in advance of the casting cavity where the belt curves down and access is readily available. This is shown in FIG. 5. The arrangement of the cables 44 extending from the sensor devices 35 will be described more fully later in connection with FIG. 7. The cooling water injection system is preferably turned on (since this affects the separation of the belts as it positions the belts relative to the underlying nozzles 31) and the belt gap is set precisely to the desired spacing. The belts are set in motion at a slow speed (e.g. about 3 meters/minute) as shown by the arrows and the probe 39 is drawn into the casting cavity as shown in FIG. 6 and advanced slowly through the casting cavity in the casting direction. The belts are stopped when the apparatus passes through the exit of the casting cavity and are then preferably reversed so that the apparatus may be returned to its starting position. In cases where the belts cannot be reversed, an operator removes the sensor devices 35 from the alignment unit 38, the sensor devices are dragged backwards through the caster cavity, the alignment unit is peeled off the lower belt and returned to the front of the machine. The belts are rotated further until they are in the same position as they were for the first pass, and the process is repeated. The operation is preferably repeated twice more with the sensor devices 35 and alignment unit 38 shifted some fixed distance sideways from their original positions.

During the advancement through the casting cavity, the sensor devices 35 continuously generate signals representing the distance X (see FIG. 4) between the upper end of the sensor unit 40 and the adjacent part of the upper casting surface 14. These signals are fed to a controller unit 50, shown in FIG. 7, via the cables 44. This unit 50 (e.g. a Keyence® model EX-V64) conditions an electrical signal supplied to the sensor units 35, receives the electrical signal returned from the sensor and converts the electrical signal to a numerical readout. Normally, the sensor units 35 and controller unit 50 are pre-calibrated together so that the numerical data shown is the actual distance X measured (e.g. in mm).

A data acquisition unit 51 converts electrical signals (representing distances measured) from controller unit 50 to a digital format compatible with a computer and stores the information digitally. Subsequent analysis of the data is accomplished by downloading the information from the data acquisition device 51 to a computer 52.

Figure 8:
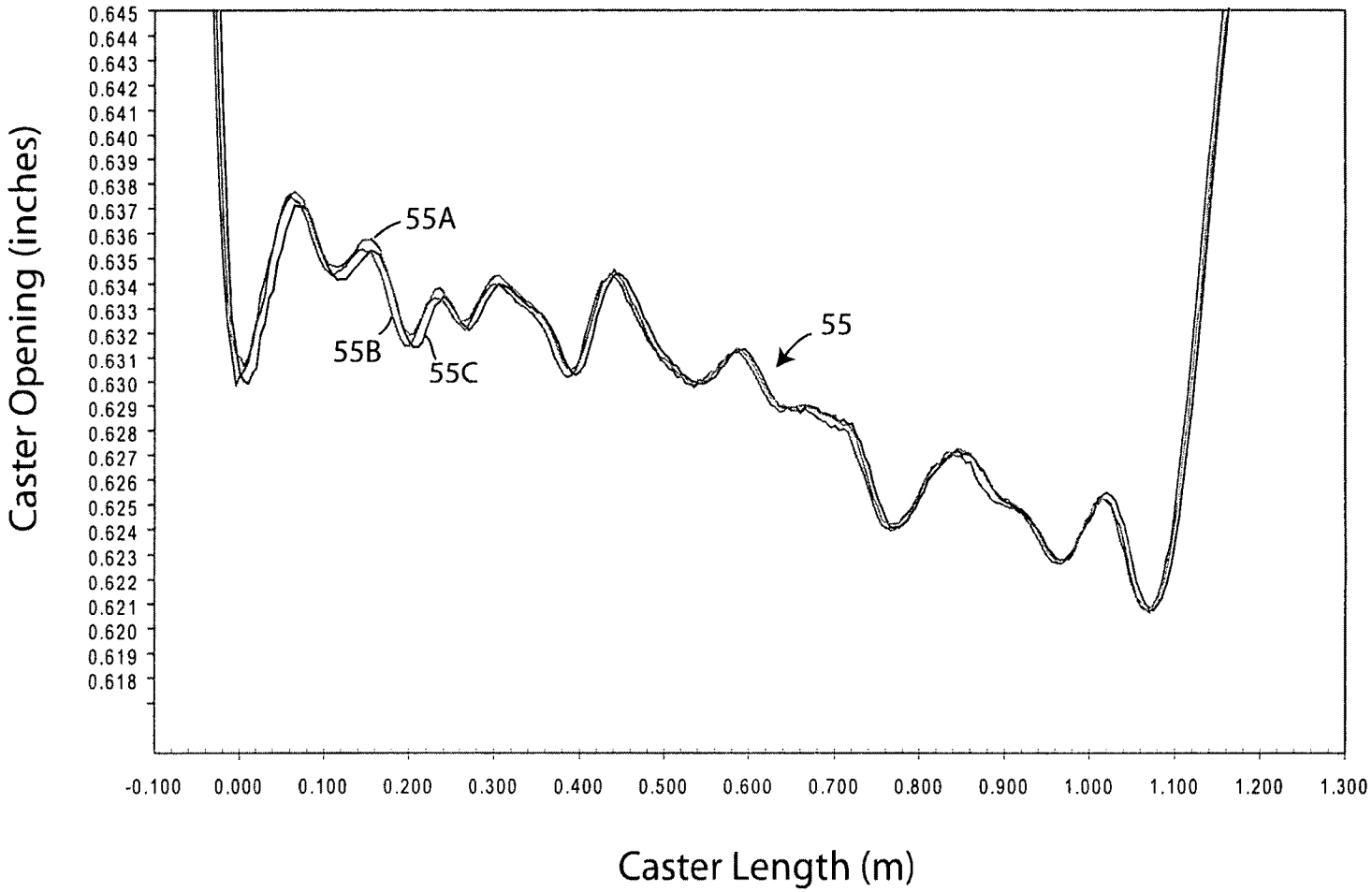
FIG. 8 is a graph showing an output from one of the sensor devices of FIG. 7 as the apparatus moves through the casting cavity.
Figure 9:
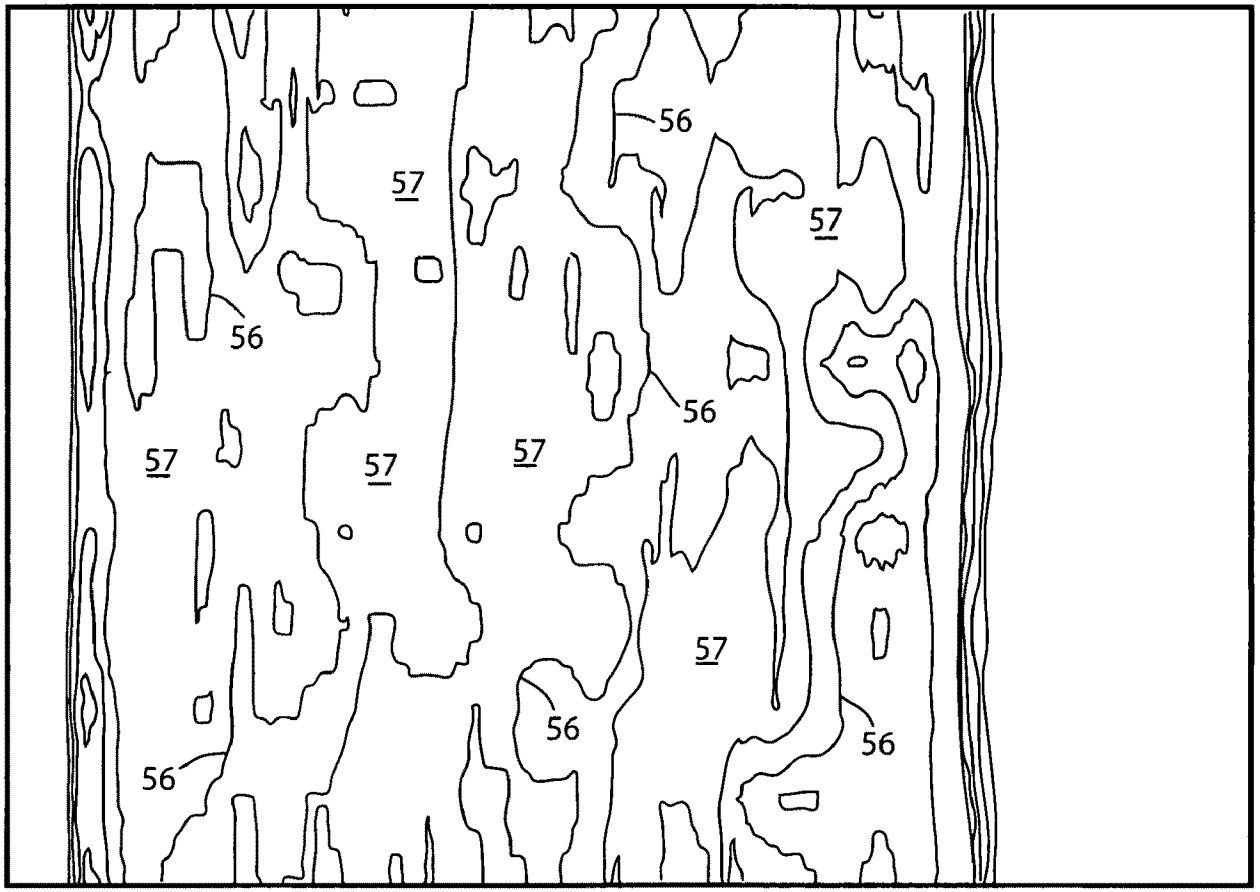
FIG. 9 is contour diagram showing the contours of the casting cavity between two casting belts generated from the outputs from the sensor devices of FIG. 7.

The data from the signals produced during each of the (preferably three) measurements are pooled and analyzed by the computer 52 and the results are preferably printed out or shown on a display device. The output from one of the sensor units 40 is shown in graphical form in FIG. 8 (where the separation trace 55 as shown is made up of three lines 55A, 55B and 55C corresponding to three measurement passes). The output from all of the sensors and all of the passes may be combined to produce a contour map of the casting cavity, as shown in FIG. 9. The lines 56 link points of equal separation and the areas 57 between them may be displayed with different colors to further facilitate the comprehension of the results.

The length of the cables 44 is made such that the probe 39 may be moved completely to and through the exit of the casting cavity without stretching and they are slowly fed into the mold cavity as the probe 39 advances. To avoid any possibility of the cables 44 being pulled from the sensor units 40 during the advancement, the cables 44 are preferably clamped by brackets 60 which are themselves firmly but removably attached to the casting surface 15 of the lower casting belt 12 (e.g. by virtue of being made of a magnetic material).

The sensor devices 35 are preferably spaced about 8 inches (20 cm) apart across the casting surface. After one set of measurements has been made, the probe 39 may be moved as a unit to the left or the right preferably by an amount of less than 8 inches (20 cm) and the measurement repeated. This displacement and re-measurement may be repeated several times. It is possible by this means to generate data at intermediate locations across the belt surface. The greater the number of measurements taken at intermediate locations, the greater will be the accuracy of the data generated. The nozzle end surfaces 30 that support the belts are usually 3.5 cm in diameter. Therefore, to detect defects caused by tilting or incorrect elevation of individual nozzles, the distance between sensor devices 35 may be set to a maximum value that is in the order of the diameters of the individual nozzles (i.e. 3.5 cm in this case), or the movements to the left or right for measurements of intermediate locations may be adjusted by the same amount.

The sensor devices 35 determine the total distance between the casting surfaces (or, more accurately, the separation of the sensor unit 40 from the adjacent casting surface), and they do not indicate which casting surface is responsible for any change in this total distance. Once a disturbance in the planarity of the casting surfaces is detected, the operator may open the casting apparatus (e.g. by raising the upper belt), and check the casting surfaces for planarity in the area of interest (e.g. by using a straight edge) to detect out-of-plane distortion of either casting surface. A nozzle elevation may then be changed if one is observed to be elevated above, or depressed below, the others or otherwise out of plane. The exemplary embodiments may also reveal that a caster carriage is tilted from one side to the other with respect to the second carriage (i.e. a 'wedge' is present in the casting cavity), or the convergence of the two belts is not as desired. Suitable adjustments may then be made.

If it is desired to measure any distortions of one of the belts, rather than lack of planarity of the casting surfaces, this can be done by one of two ways. Firstly, it is possible to drag the sensor units 35 carefully through the casting cavity while casting surfaces are stationary, thereby allowing the sensing devices to "see" different regions of the casting surfaces. Alternatively, a probe 39 may be attached to one of the casting surfaces as indicated above, the surface moved to advance the probe into the casting cavity and then stopped, and the other casting surface moved so that it moves past the probe. In practice, it is expected that the casting cavity will vary with a belt's rotational position, as the belts are not strictly uniform (they are normally welded from several sections). The observed heat flux data reveals what is termed a 'belt signature' as the molten metal contacts different areas of the belt as it moves into the casting cavity. Part of this 'signature' may well be due to the effect of the belt on the casting cavity thickness/shape. During measurement of the caster cavity, as opposed to a belt, care is taken to eliminate the effect of the belt signature by always placing the sensors in the same position along the length of the belt.

As mentioned above, in casters of the kind shown in FIG. 1, it is usual to provide the casting cavity with a slight inward convergence from entrance to exit to allow for the contraction of the metal slab during cooling and solidification. The apparatus of the exemplary embodiments may also be used to measure such a convergence.

The exemplary embodiment described above may of course be modified in many ways without departing from the scope of the present invention as defined by the following claims. For example, instead of using electromagnetic inductance units 40, distance sensors of other kinds may be provided, e.g. laser range finders, spring-loaded pins that ride over the adjacent belt surface, and the like, provided that they can fit within the casting cavity, resist the heat likely to be encountered and provide suitably accurate measurement. However, inductive displacement sensors as described above are presently most preferred because of their accuracy and precision. While they work best when the casting surfaces are made of steel or other ferromagnetic material, they may actually be used with casting belts made of other materials, e.g. copper or aluminum. When this is so, the sensor units produce a signal that is inversely proportional to the distance from the copper or aluminum casting surface over a certain range, so the sensors may be used with an appropriate calibration conversion factor.

When using ferromagnetic casting surfaces, it is most convenient to attach the sensor devices 35 and the alignment unit 38 to one of the surfaces magnetically. However, other means of temporary attachment may be employed, and would be required if using the apparatus with casting surfaces made of non-ferrous metal, e.g. copper or aluminum. Alternative means of temporary attachment include, but are not limited to, the use of suction cups, vacuum, weak adhesive, double-sided adhesive tape, etc.

The use of spacing element 41 is optional. For example, if the sensor unit 40 has a height that positions its upper surface within sensing range of the adjacent casting surface, then the spacing element is not required. However, since the sensor devices 35 will normally be used with casting apparatuses having different casting cavity heights, a supply of one or more spacing elements 41 of different heights makes the sensor devices 35 effective for all such apparatuses.

The apparatus may be provided in kit form with instructions for assembly and use. A preferred kit of this kind would include sensor devices, at least one alignment unit, spacers of different heights as well as the control units, cables and preferably cable clamps.

I claim:

1. A method of measuring the separation of moving confronting casting surfaces within a casting cavity of a casting apparatus, comprising:

attaching at least one separation sensing device to a first one of a pair of confronting casting surfaces outside a casting cavity, moving said casting surfaces to advance said at least one sensing device through the casting cavity while operating said devices to generate signals;

monitoring said signals continuously or at regular intervals; and converting said monitored signals to distance measurements representing separation of said surfaces at a plurality of positions through said casting cavity wherein said at least one separation sensing device is attached to said first one of the pair of confronting casting surfaces by releasable means.

2. The method of claim 1, wherein a plurality of said sensing devices are attached to said one of the pair of confronting casting surfaces, said sensors being separated laterally from each other.

3. The method of claim 2, wherein an alignment unit is positioned on said first one of the pair of confronting casting surfaces before said attaching of said devices, and said alignment device is used to position said devices at predetermined positions on said first surface when attaching said devices.

4. The method of claim 1, wherein, after said at least one sensing device has been advanced through said casting cavity, said at least one sensing device is removed from said first surface and re-attached to said first or second surface in advance of said casting cavity, and said casting surfaces are again moved for a second measuring pass through said casting cavity while carrying out said monitoring and converting of said signals.

5. The method of claim 1, wherein, after said at least one sensing device has been advanced through said casting cavity, said at least one sensing device is drawn back through said casting cavity to a position in advance of said casting cavity, and said casting surfaces are again moved for a second measuring pass through said casting cavity while carrying out said monitoring and converting of said signals.

6. The method of claim 4, wherein said re-attachment or drawing back of said at least one sensor and said movement of said casting surfaces are repeated one or more time for one or more additional measuring passes.

7. The method of claim 4, wherein, between each measuring pass, said at least one sensor is moved laterally across said first or second casting surface to measure separation at different lateral positions through the casting cavity on each measuring pass.

8. The method of claim 1, wherein said at least one of said sensing devices is operated to sense separation from a second one of said confronting casting surfaces by means of electromagnetic inductance.

9. The method of claim 1, wherein said releasable means employ magnetism.

10. The method of claim 1, wherein said at least one sensing device is adjusted in height before said moving of said casting surfaces advances said at least one device into said casting cavity.

11. A method of measuring the separation of moving confronting casting surfaces within a casting cavity of a casting apparatus, comprising:

attaching at least one separation sensing device on a first one of a pair of confronting casting surfaces outside a casting cavity, moving said first one of the pair of casting surfaces to advance said at least one sensing device into the casting cavity and then stopping further movement of said first surface;

moving a second one of the pair of casting surfaces through the casting cavity; operating said at least one sensing device to generate signals;

monitoring said signals continuously or at regular intervals; and converting said monitored signals to distance measurements representing separation of said surfaces at a plurality of positions through said casting cavity wherein said at least one separation sensing device is attached to said first one of the pair of confronting casting surfaces by releasable means.

* * * * *